US006591759B2

(12) United States Patent
Bullock

(10) Patent No.: US 6,591,759 B2
(45) Date of Patent: Jul. 15, 2003

(54) PEDESTAL SHEAR PAD

(75) Inventor: Robert L. Bullock, Loudon, TN (US)

(73) Assignee: Standard Car Truck Company, Park Ridge, IL (US)

( * ) Notice: Subject to any disclaimer, the term of this patent is extended or adjusted under 35 U.S.C. 154(b) by 0 days.

(21) Appl. No.: 09/995,541

(22) Filed: Nov. 28, 2001

(65) Prior Publication Data

US 2003/0097955 A1 May 29, 2003

(51) Int. Cl.[7] ..... B61F 5/26
(52) U.S. Cl. ..... 105/224.1
(58) Field of Search ..... 105/225, 224.1, 105/222, 198.2

(56) References Cited

U.S. PATENT DOCUMENTS 3,276,395 A * 10/1966 Heintzel ..... 105/224.1
3,699,897 A * 10/1972 Sherrick ..... 105/224.1
4,203,371 A * 5/1980 Tack ..... 105/225
4,785,740 A * 11/1988 Grandy ..... 105/225
4,938,152 A * 7/1990 List ..... 105/224.1
5,237,933 A * 8/1993 Bucksbee ..... 105/224.1
5,425,312 A * 6/1995 Tack, Jr. ..... 105/225
5,799,582 A * 9/1998 Rudibaugh et al. ..... 105/224.1
5,924,366 A * 7/1999 Trainer et al. ..... 105/225
6,178,894 B1 1/2001 Leingang ..... 105/224.1
6,234,083 B1 * 5/2001 Tack, Jr. ..... 105/224.1
6,347,588 B1 * 2/2002 Leingang ..... 105/224.1
6,422,155 B1 * 7/2002 Heyden et al. ..... 105/224.1

* cited by examiner

*Primary Examiner*—S. Joseph Morano
*Assistant Examiner*—Lars A. Olson
(74) *Attorney, Agent, or Firm*—Cook, Alex, McFarron, Manzo, Cummings & Mehler, Ltd.

(57) ABSTRACT

A shear pad assembly for use between a rail car side frame pedestal and the rail car roller bearing adapter includes an upper plate formed and adapted to seat the side frame pedestal and a lower plate, spaced from the upper plate, and formed and adapted to seat on the roller bearing adapter. There is an elastomer positioned in the space between the upper plate and the lower plate, with the elastomer having a generally uniform thickness throughout a substantial portion of the space between the plates. There are a pair of spaced metal shims, each extending parallel to a side frame, being adjacent an edge of the elastomer, and being located generally intermediate the upper and lower plates.

6 Claims, 2 Drawing Sheets

Fig. 1.
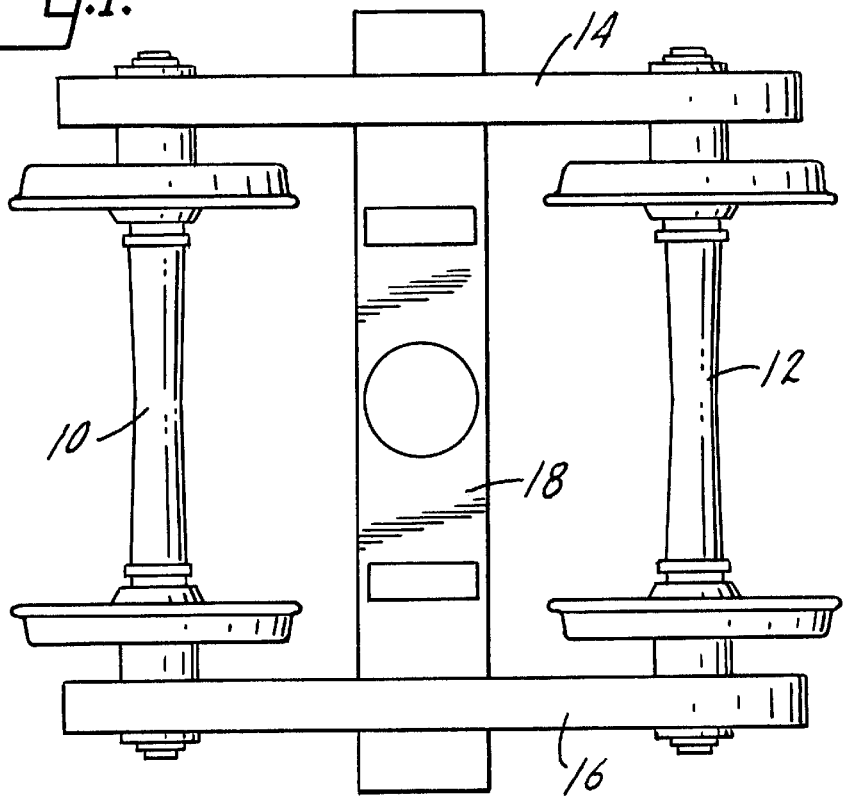
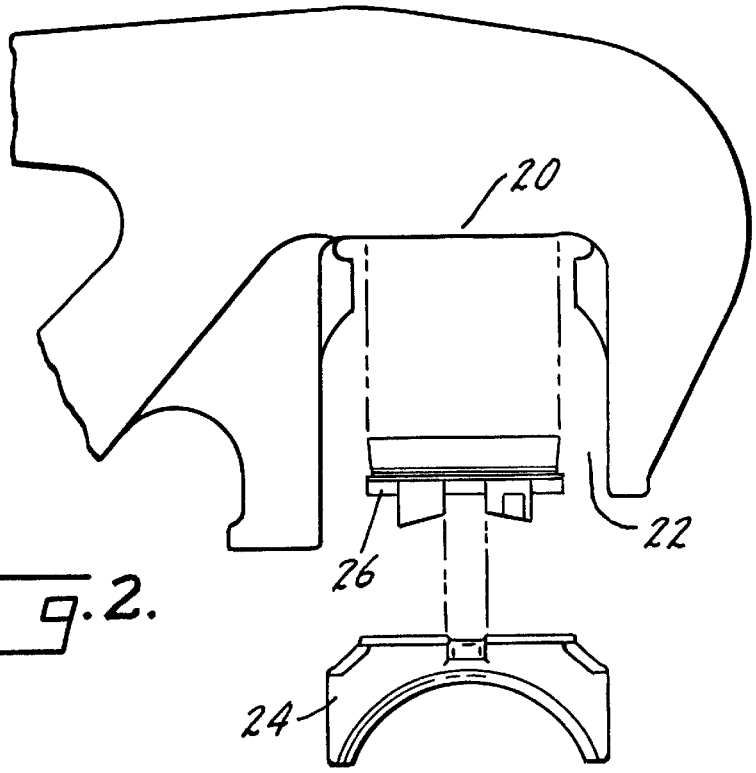
Fig. 2.

Fig.3.
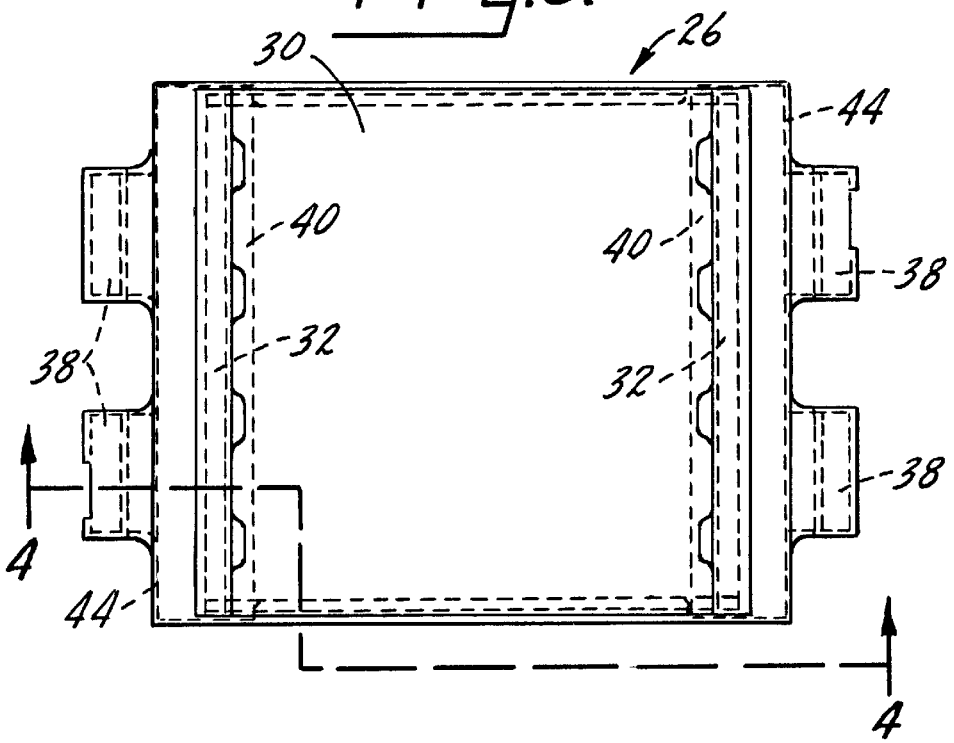
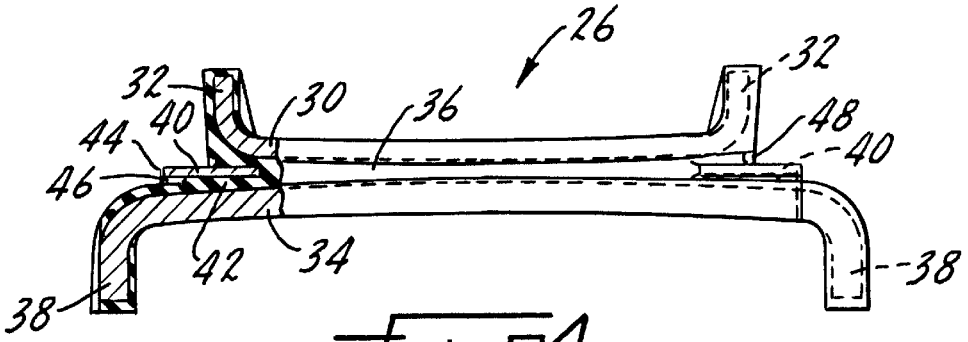
Fig.4.
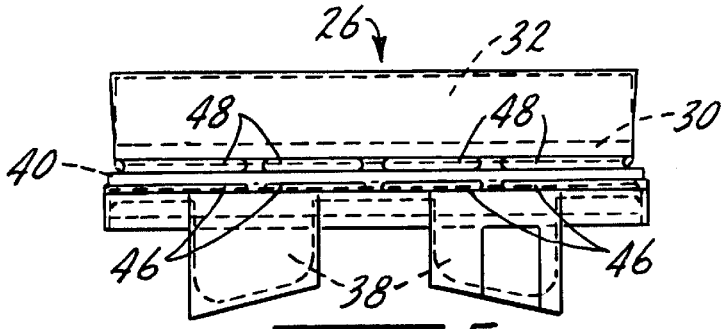
Fig.5.

PEDESTAL SHEAR PAD

THE FIELD OF THE INVENTION

The present invention relates to a shear pad assembly adapted to be positioned between a rail car side frame pedestal and the rail car roller bearing adapter, and more specifically, to such a shear pad assembly which includes an elastomer positioned between spaced upper and lower plates and metal shims for reinforcing and supporting the elastomer.

Shear pads have long been known in the rail car art for use in supporting the truck side frames on the wheelsets. Initially, such shear pad assemblies utilized metal wear surfaces which permitted limited lateral and longitudinal movement of the side frames relative to the roller bearing adapters positioned on the wheelsets. Subsequently, elastomeric mountings took the place of the metal wear surfaces to provide control flexibility in all directions, particularly for self-steering rail car trucks.

U.S. Pat. No. 5,237,933 improved the elastomeric mounting by the addition of a single metal shim which extended generally throughout the elastomer with the stated advantage of significantly increasing the service life of the shear pad. One aspect of the shear pad described in the '933 patent was to increase the thickness of the elastomeric layer adjacent its edge, as compared with the thickness at the center of the elastomer to reduce the edge strains imposed on the shear pad. This stated advantage, however, did not prove to be correct in that the reduction of the elastomer thickness adjacent its center resulted in separation of the elastomer under prolonged loading. The present invention provides an elastomer which is more uniform throughout the cross section of its thickness, resulting in more uniform shear which has the effect of spreading the shear load imposed on the pad more uniformly across the pad, eliminating the concentration of shear strain present in pads of the type shown in the '933 patent.

SUMMARY OF THE INVENTION

The present invention relates to shear pad assemblies for use in rail car trucks to support the side frames on the wheelset roller bearing adapters and more specifically, to a shear pad for the use described which has an improved reinforced elastomer.

A primary purpose of the invention is to provide a shear pad assembly as described in which the elastomer, positioned between upper and lower plates of the shear pad assembly, has a pair of spaced reinforcing shims.

Another purpose of the invention is to provide a shear pad assembly as described in which the elastomer is substantially uniform across its cross sectional area to spread the shear load relatively uniformly across the pad.

Another purpose of the invention is to provide a shear pad assembly which does not concentrate the shear load at the center area of the pad.

Another purpose of the invention is to provide a shear pad assembly having shims to stiffen the elastomer edges so that the overall stiffness of the pad is generally uniform.

Another purpose of the invention is to provide a shear pad assembly as described in which the maximum shear strain is reduced, but the overall shear strain is more uniform throughout the thickness of the cross sectional area of the elastomer.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view of a rail car truck illustrating the various components thereof;

FIG. 2 is a partial exploded side view of the side frame, shear pad and roller bearing adapter forming a part of the rail car truck of FIG. 1;

FIG. 3 is a top plan view of the shear pad;

FIG. 4 is a section along plane 4—4 of FIG. 3; and

FIG. 5 is a front view of the shear pad assembly of FIGS. 3 and 4.

DESCRIPTION OF THE PREFERRED EMBODIMENT

The present invention relates to an elastomeric shear pad assembly for use in mounting the side frames of a three-piece rail car truck to the roller bearing adapters which rest on the wheelsets. Such assemblies have long been known in the art and they provide control flexibility in all directions and have substantial advantage over previously-used metal to metal sliding surfaces or similar wear surfaces. Such advantages include reduced lateral and vertical shocks to the roller bearings, increased system damping, elimination of wear between the roller bearing adapter crown surface and the side frame pedestal jaw roof, reduction in rail car wheel wear, reduced rail wear, and improved life of the truck components.

U.S. Pat. No. 5,237,933 discloses a shear pad assembly utilizing an elastomer between the upper and lower plates of the assembly, with the elastomer being reinforced by a metal shim which extends generally midway through the elastomer. One of the perceived advantages of the shear pad assembly in the '933 patent was to decrease the compression induced edge strains by increasing the thickness of the elastomer toward its edges, while reducing the thickness of the elastomer in the center of the shear pad assembly. The '933 patent stated that an optimum ratio of the thicknesses of the edge of the elastomer to the center is as high as 1.3 to 1.

Shear pad assemblies of the type shown in the '933 patent have been determined to fail in the center under substantial shear load; particularly, there has been noticed a separation of the elastomer because the pad is thinnest at its center, but yet the rubber or elastomer in the center is doing the most work in resisting shear and compression loads. The present invention substantially improves the shear pad assembly of the '933 patent by providing a generally uniform thickness of the elastomer throughout its cross sectional area and reinforcing the edges by separate, independent shims, which are positioned along the pad edges and are generally parallel to the direction of the side frames. With this construction the elastomer is more uniform throughout the cross section of the pad, with the result that the elastomer is more uniform in shear. This in effect spreads the shear load relatively uniformly across the pad and does not concentrate it in the center. The elimination of shims in the center of the shear pad may weaken the center in stiffness, but by stiffening the edges, the overall stiffness of the shear pad is uniform across its width. The maximum shear strain is reduced, but the shear strain is more uniform throughout its width, creating a shear pad assembly which has a substantially extended life over those known in the prior art.

A further advantage of the shear pad assembly of the present invention is that it is thinner in height by approximately ⅛" over that shown in the '933 patent and such a reduction in height is important to railroads, as it insures that there can be a retrofit of the shear pad assembly without having car couplers being non-aligned.

In FIG. 1 a conventional three-piece truck has wheelsets 10 and 12 upon which are supported side frames 14 and 16. A bolster 18 connects the side frame, as is conventional in rail car trucks of this design. The side frames include side frame pedestals 20 with an opening 22 within which will be located the roller bearing adapter 24 and a shear pad assembly 26. It should be understood that the portion of the side frame, roller bearing adapter and shear pad assembly shown in FIG. 2 will be present at each of the four corners of the truck shown in FIG. 1. The invention is particularly concerned with the shear pad assembly which is illustrated in detail in FIGS. 3, 4 and 5.

The shear pad assembly includes an upper plate 30, conventionally formed of steel, and having up-turned side edges 32, with the plate 30 forming a seat for the side frame pedestal 20.

There is a lower steel plate 34 in the shear pad assembly 26 which is spaced from the upper plate 30 by a thickness 36. The lower plate 34 will have down-turned projections 38 at opposite sides thereof, as particularly illustrated in FIG. 5. The space 36 will be filled by a suitable elastomer 42 which will both fill the space 36 and substantially encapsulate both the upper plate 30, its up-turned edges 32, the lower plate 34 and its down-turned edges 38. Elastomers to perform this function are well known in the art.

There are a pair of spaced metal shims 40 embedded in the space 36 which is filled by the elastomer, with the shims being essentially parallel to each other, and parallel to the direction of the side frames 14 and 16. The shims are identical in width, thickness and length and each will be embedded within the elastomer 42. Each shim will have its outer edge 44 outside of the up-turned edges 32 and inside of the down-turned edges 38. Directly adjacent and slightly inside of the outer edge 44 of each shim there is a concavity 46 in the elastomer. Similarly, there is a concavity 48 in the elastomer directly above the shim and generally where the elastomer joins that portion of it which encapsulates the up-turned edges 32. Such concavities or contours are useful in minimizing the compression induced edge strains in the shear pad assembly and are shown in the '933 patent.

Of importance is the fact that the elastomer 42 is generally uniform in thickness throughout its cross sectional area. This provides a more uniform resistance to shear because of the uniform thickness of the elastomeric material. The shims 40 stiffen the edges of the shear pad assembly to resist compression. Although the center of the pad may be slightly weakened in stiffness, the additional stiffening provided at the edges by the shims provide a more uniform stiffness across the cross section of the pad. The maximum shear strain of the pad assembly may be reduced over that shown in prior art assemblies for the same function, but the overall shear strain is more uniform, resulting in a shear pad assembly having substantially increased life.

The shear pad assembly will be thinner than that of the prior art because of the absence of a shim in the center of the elastomer. This reduced thickness, by approximately 0.120" is very advantageous in retrofitting the shear pad assembly to existing rail cars, as it reduces the potential for non-aligned couplers.

Whereas the preferred form of the invention has been shown and described herein, it should be realized that there may be many modifications, substitutions and alterations thereto.

The embodiments of the invention in which an exclusive property or privilege is claimed are as follows:

1. A shear pad assembly for use between a rail car side frame pedestal and a rail car roller bearing adapter, said shear pad assembly including an upper plate formed and adapted to seat the side frame pedestal, and a lower plate, spaced from said upper plate and formed and adapted to seat on the roller bearing adapter, the upper and lower plates defining a longitudinal centerline, an elastomer positioned in the space between said upper plate and said lower plate, said elastomer having a generally uniform thickness throughout a substantial portion of the space between said plates, and first and second independent, spaced metal shims, each extending generally parallel to a side frame, being adjacent an edge of the elastomer and laterally spaced from the longitudinal centerline, and being located intermediate the upper and lower plates.

2. The shear pad assembly of claim 1 wherein said shims are each generally equal in width.

3. The shear pad assembly of claim 1 wherein said shims are each located generally midway between said upper and lower plates.

4. The shear pad assembly of claim 1 wherein said upper and lower plates are generally encapsulated by the elastomer positioned in the space between said plates.

5. The shear pad assembly of claim 1 wherein said upper plate has generally up-turned edges and said lower plate has generally down-turned edges, with said up-turned and down-turned edges extending generally perpendicular to said shims.

6. The shear pad assembly of claim 1 wherein each of said shims is generally equal in width, with the inner edge of each shim being located inside of the boundary of the upper plate and the outer edge of each shim being located outside of the boundary of the upper plate, each of said shims being substantially covered by said elastomer.

* * * * *